US006332662B1

(12) United States Patent
Choi

(10) Patent No.: US 6,332,662 B1
(45) Date of Patent: Dec. 25, 2001

(54) TECHNIQUE FOR IMPROVING PRINTING QUALITY

(75) Inventor: Seung-Young Choi, Kyungki-do (KR)

(73) Assignee: SamSung Electronics., Ltd., Suwon (KR)

( * ) Notice: Subject to any disclaimer, the term of this patent is extended or adjusted under 35 U.S.C. 154(b) by 0 days.

(21) Appl. No.: 09/216,953

(22) Filed: Dec. 21, 1998

(30) Foreign Application Priority Data

Dec. 19, 1997 (KR) ..... 97-70918

(51) Int. Cl.[7] ..... B41J 29/393
(52) U.S. Cl. ..... 347/19
(58) Field of Search ..... 347/19, 43, 44, 347/41, 23, 67

(56) References Cited

U.S. PATENT DOCUMENTS 6,045,210 * 4/2000 Suzuki et al. ..... 347/19

FOREIGN PATENT DOCUMENTS

0783973 * 7/1997 (EP) .
60104335 * 8/1985 (JP) .

* cited by examiner

*Primary Examiner*—John Barlow
*Assistant Examiner*—Ly T Tran
(74) *Attorney, Agent, or Firm*—Robert E. Bushnell, Esq.

(57) ABSTRACT

A method for efficiently compensating for malfunctioning nozzles in a printhead. A print order is input, malfunctioning nozzles on a printhead are identified, and, in the case malfunctioning nozzles are present, compensation printing occurs to optimize print quality. The detecting of malfunctioning nozzles includes printing a test pattern, scanning the test pattern, comparing the scanned test pattern to an ideal test pattern, and then identifying the locations of malfunctioning nozzles. In the case that only one nozzle is malfunctioning, the number of nozzles used to scan a line of print is reduced by two so that compensation printing can correct two lines of print with one single swath.

11 Claims, 3 Drawing Sheets

TECHNIQUE FOR IMPROVING PRINTING QUALITY

CLAIM OF PRIORITY

This application makes reference to, incorporates the same herein, and claims all benefits accruing under 35 U.S.C. §119 from the application entitled Printing Quality Improving Method filed with the Korean Industrial Property Office on Dec. 19, 1997 and there duly assigned Serial No. P97-70918 by that Office.

FIELD OF THE INVENTION

The present invention relates to a method for improving printing quality, more particularly, to a method for improving printing quality by printing through functioning nozzles, and reprinting over areas of non-functioning nozzles when non-functioning nozzles are present. The detection of non-functioning nozzles is accomplished by printing and scanning a piece of printed material.

DISCUSSION OF RELATED ART

Generally, an inkjet printer prints by jetting ink on paper through a number of nozzles by activating a number of electrical signals being applied to a jetting part of an ink head. However, alien substances may be inserted into any nozzle among nozzles jetting ink or a certain nozzle may not be continuously utilized. In those cases, any nozzle among the nozzles can be stopped or an electrical signal needed for jetting ink cannot be applied to a certain nozzle. As a result, malfunctioning nozzles, through which ink cannot be jetted in printing, may be formed. In earlier techniques, when an inkjet printer has malfunctioning nozzles, the ink head cannot jet ink through the malfunctioning nozzles. Accordingly, white lines formed on printing paper in a horizontal direction, and so the printing quality falls off.

SUMMARY OF THE INVENTION

Accordingly, in order to overcome such drawbacks in the earlier art, it is an object of the present invention to provide a method for improving printing quality by printing over these white lines using functioning nozzles. A scanner is used to detect the presence and location of any non-functioning nozzles so that the functioning nozzles can make-up for the non-functioning nozzles.

To achieve these and other advantages and in accordance with the purpose of the present invention, as embodied and broadly described, there is provided a printing quality improving method comprising the steps of: inputting a printing order; detecting the presence and absence of malfunctioning nozzles among the nozzles of the jetting part in the inputting step and a position and number of malfunctioning nozzles in case malfunctioning nozzles are present; printing firstly as much as a width of a printing band having a reference line distance set by a line feed value in case of the absence of a malfunctioning nozzle in the detecting step; printing secondly a compensation letter line of one line for each of two lines by moving a normal nozzle to two malfunctioning nozzle positions of each two neighboring lines, after printing with a first printing band, which has a smaller first line distance than the reference line distance, in case of the presence of a single malfunctioning nozzle in the detecting step; and printing thirdly as much as a width of the printing band having the line distance by positioning a normal nozzle at a position of detected malfunctioning nozzles for every line having the reference line distance, printing as much as the width of the reference printing band having the reference line distance for every line in case of the presence of two or more malfunctioning nozzles in the detecting step.

Further, the detecting step comprises the steps of: printing a test printing pattern for detecting the presence or absence of malfunctioning nozzles; reading the printing pattern printed in the test printing step with a scanner; comparing the data read in the reading step with the printing data in the test printing step; and detecting the number and position of malfunctioning nozzles in the case malfunctioning nozzles are present, comparing whether the read data are accorded with the printed data in the comparing step.

Furthermore, the first printing band subtracts 2 from the number of nozzles.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF THE INVENTION

Figure 1:
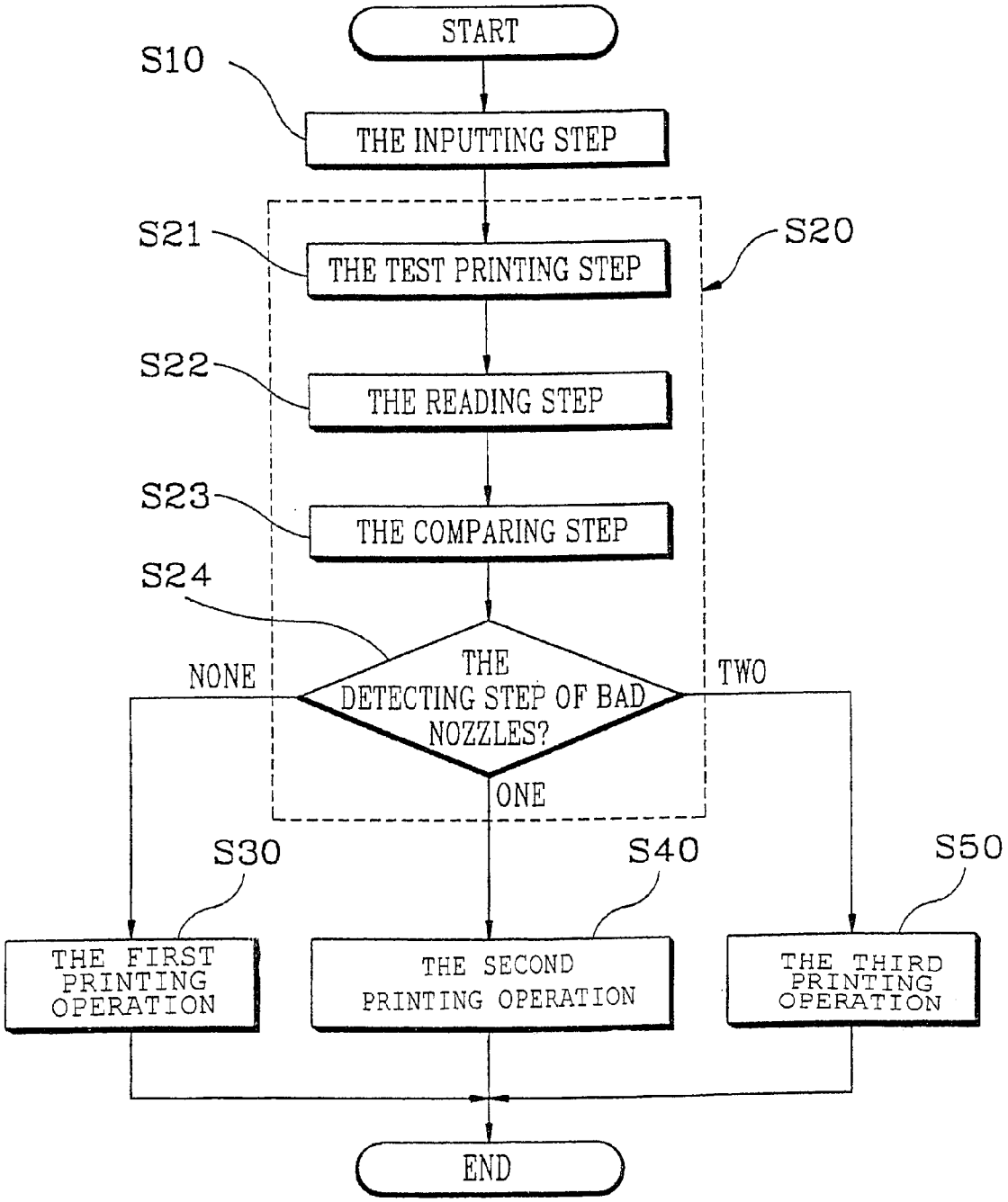
FIG. 1 is a flow view illustrating a method for improving printing quality according to the present invention.

FIG. 1 is a flow chart illustrating a method for improving printing quality. A printing quality improving method for printing as much as a width of a printing band, which has a reference line distance set by a line feed value, by jetting ink through a number of nozzles of the jetting part, being provided with a jetting part having a number of nozzles, the method comprises the steps of: inputting S10 a printing order; detecting S20 the presence or absence of malfunctioning nozzles among the nozzles of the jetting part in the inputting step, and the position and number of malfunctioning nozzles in case of the presence of malfunctioning nozzles; printing S30 firstly as much as a width of a printing band having a reference line distance set by a line feed value in case of the absence of a malfunctioning nozzle in the detecting step; printing S40 secondly a compensation letter line of one line for each of two lines, by printing a first printing band, which has a smaller first line distance than the reference line distance, moving a functioning nozzle to two malfunctioning nozzle positions of every two neighboring lines in case of a single malfunctioning nozzle discovered in the detecting step; and printing S50 thirdly as much as a width of the printing band having the line distance for every line by positioning a functioning nozzle at a position of first malfunctioning nozzle (DOT $\beta 1$) of detected malfunctioning nozzles having the reference line distance, printing as much as the width of the reference printing band having the reference line distance for every line in case of two or more malfunctioning nozzles in the detecting step.

Here, line does not mean a line of printed letters from the viewpoint of a user, but a line formed by each nozzle forms by the movement of a head in the printing operation.

The detecting step S20 comprises the steps of printing S21 a test printing pattern for detecting the presence or absence of malfunctioning nozzles; reading S22 the printing pattern printed in the test printing step S21 with a scanner; comparing S23 the data scanned in the reading step S22 with the printing data in the test printing step S21; and detecting S24 the number and position of malfunctioning nozzles when malfunctioning nozzles are present, comparing whether the scanned data agree with the printed data in the comparing step S23.

The test printing step S21 gets ink jetted through all the nozzles, activating electrical signals for determining the functionality for each of the nozzles.

Figure 2:
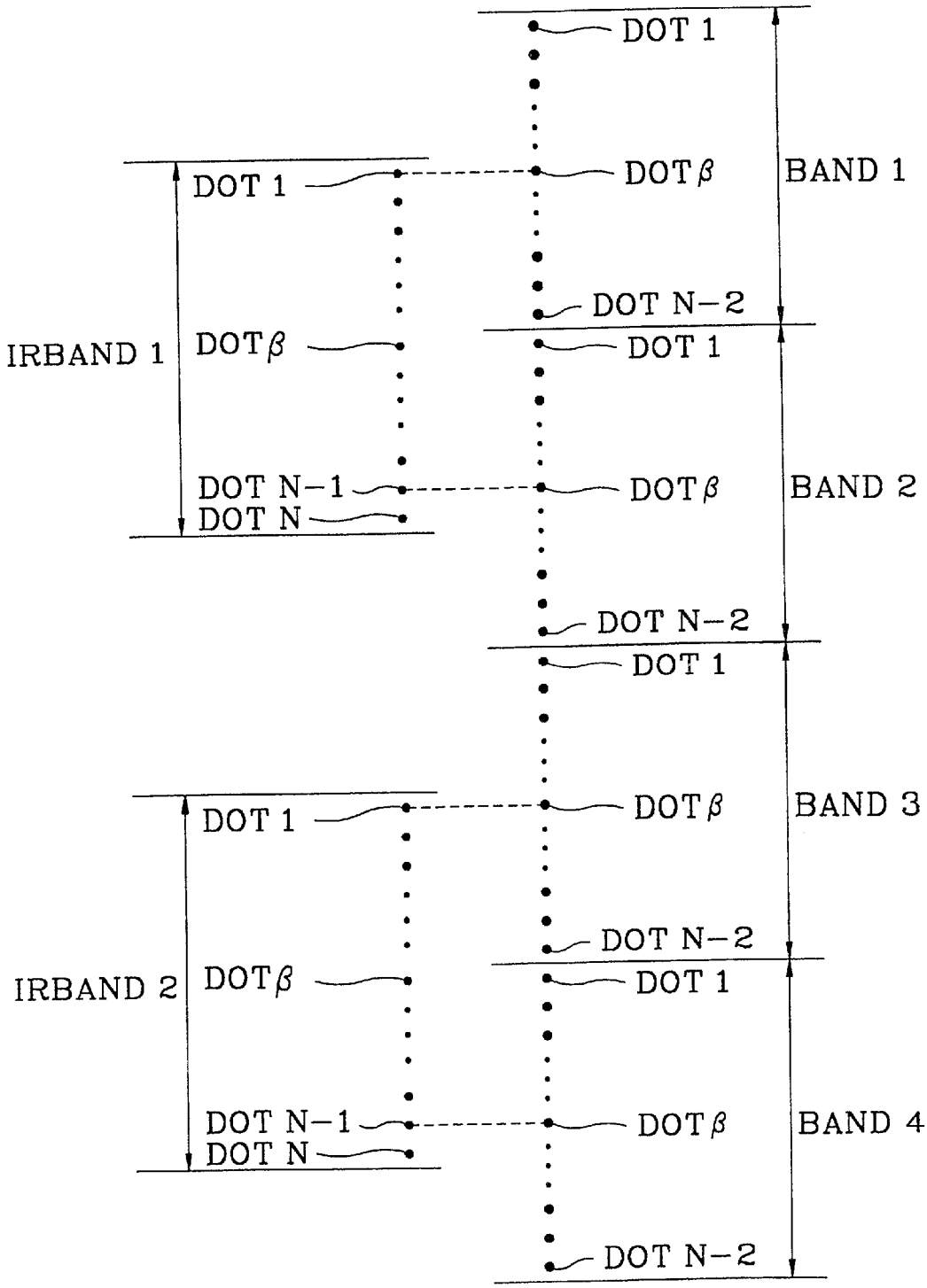
FIG. 2 is a printing status view according to the present invention in case of the presence of a malfunctioning nozzle.
Figure 3:
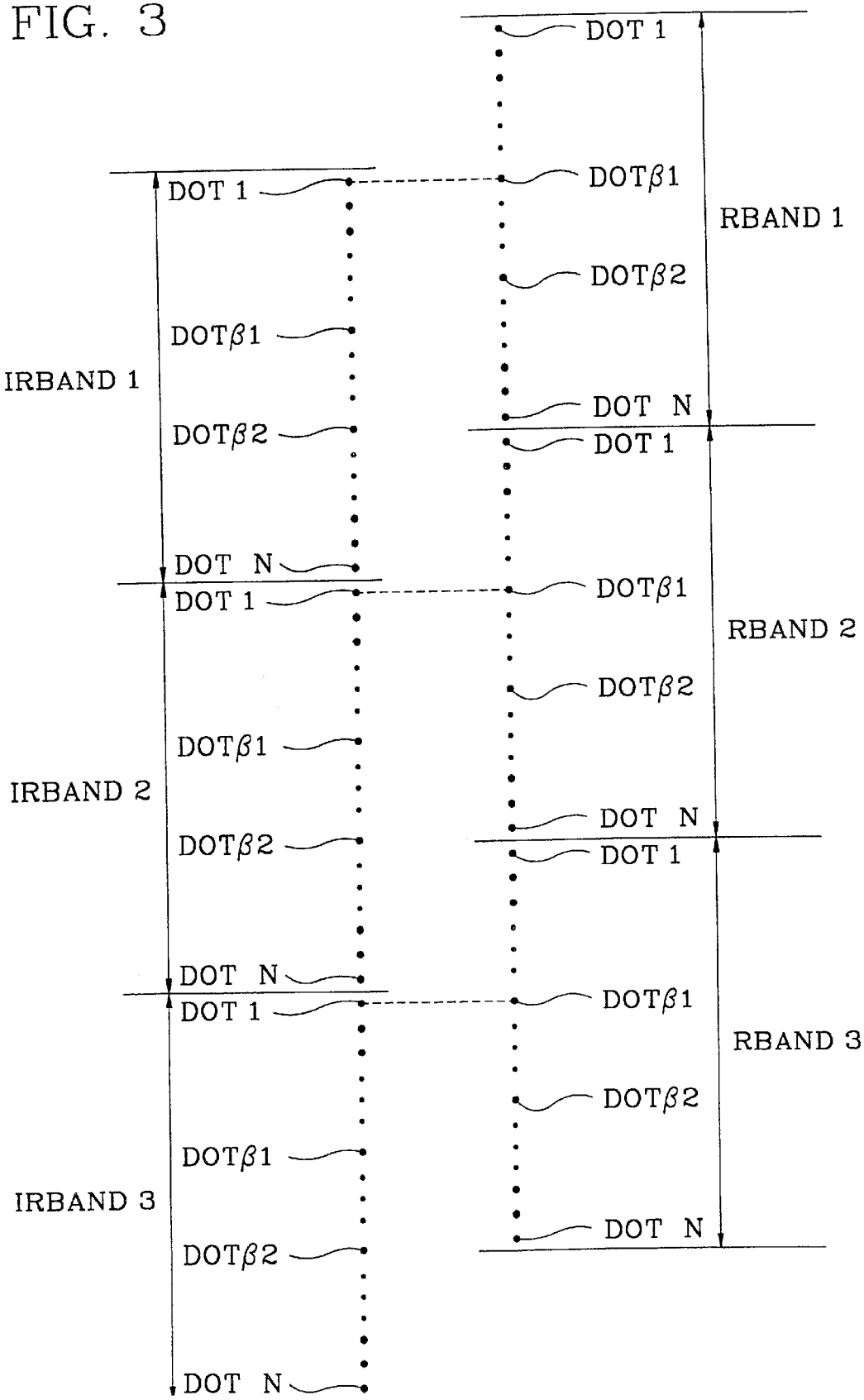
FIG. 3 is a printing status view according to the present invention in case of the presence of two or more malfunctioning nozzles.

The first printing band has a width two less than the total number of nozzles present The operation of the present invention according to the above-described construction can be described as follows. FIG. 2 is a printing status view according to the present invention in case of the presence of a single malfunctioning nozzle, and FIG. 3 is a printing status view according to the present invention in case of the presence of two or more malfunctioning nozzles.

The inputting step S10 starts printing by inputting a printing order. The detecting step S20 detects the presence or absence of malfunctioning nozzles among a number of nozzles of an ink head, as well as the position and number of the malfunctioning nozzles in case that malfunctioning nozzles are present, and therefor comprises the test printing step S21, the reading step S22, the comparing step S23, and the detecting step S24. The test printing step S21 prints a test printing pattern by getting ink jetted through all nozzles, activating electrical signals for determining the functionality for the number of nozzles respectively. The reading step S22 reads the printing pattern printed in the test printing step S21 with a scanner. The comparing step S23 compares the data read in the reading step S22 with the printing data in the test printing step S21 and the detecting step S24 detects the number and position of malfunctioning nozzles when malfunctioning nozzles are present, comparing whether the read data agree with the printed data in the comparing step S23.

For example, let us assume, when electrical signals for determining the functionality of each of the nozzles are activated to jet ink through the nozzles, bits of data corresponding to the nozzles come to have high logical value in binary, whereas when electrical signals are inactivated not to jet ink through the nozzles, bits of data corresponding to the nozzles come to have low logical value in binary. Then, as the test printing step S21 in the detecting step S20 applies activated electrical signals to each of all nozzles, all the printed data are composed of bits having high logical value. The reading step S22 reads the printing pattern printed in the test printing step S21 with the scanner. The comparing step S23 compares the printed data, composed of bits having high logical value, with the read data having low logical value owing to the malfunctioning nozzles in case of the presence of malfunctioning nozzles. The detecting step S24 rotates the line feed motor and prints on the paper for every line as much as the width of the printing band having the reference line distance set by the line feed value in the first printing operation S30 when the data read in the comparing step S23 is the same as the printed data, that is, in case of the absence of a malfunctioning nozzle.

When only one nozzle is malfunctioning, that is to say, only one bit among the bits of data read in the reading step S21 has low logical value, the detecting step S24 detects the position of the one malfunctioning nozzle, as the bit having low logical value, among nozzles. For example, in case of the presence of one malfunctioning nozzle as shown in FIG. 2, assuming that the number of whole nozzles is N and a βth nozzle is malfunctioning, the second printing operation S40 rotates the line feed motor as much as the width of the printing band having distance from dot 1 to dot N−2, which is the first line distance smaller than the line feed value, and prints as much as the width of the first printing band for every line (Band 1~Band 4), and prints by inserting an inserting band (Irband 1, Irband 2), which rotates the line feed motor as much as the width of the printing band having the reference line distance from dot 1 to dot N, into the position (dot β) of the malfunctioning nozzle detected in the detecting step S20 for every odd number of lines (band 1, band 3) among lines having the first line distance. Accordingly, in case of the presence of one malfunctioning nozzle, the operation S40 prints the first line as much as the width of the printing band (band 1) having the first line distance from dot 1 to dot N−2. As the operation S40 sets a variable of the movable step of the line feed motor so as to print from the malfunctioning nozzle position dot 1 and inserts the inserting band (Irband 1) and prints, ink is jetted into the dot β, which has not been printed in the first pass, through the normal nozzle, which is the first nozzle (dot 1) of the inserting band (Irband 1) and therefore the 13th dot occurred in the first line is finally printed. Further, as the position of the malfunctioning nozzle occurred in the second line (band 2) is normally printed by a N−1th nozzle (dot N−1) of the first inserting band (Irband 1), each inserting band (Irband) should be inserted into every odd number of lines (band 1, band 3) and printed.

FIG. 3 is a printing status view according to the present invention in case of the presence of two or more malfunctioning nozzles. The third printing operation S50 has the same operation as the second printing step S40 in case of the presence of one malfunctioning nozzle. However, the third printing step S50 rotates the line feed motor as much as the width of the printing band having the reference line distance from dot 1 to dot N and prints for every line (band 1~band 3), and prints by inserting each of inserting bands (Irband 1~Irband 3) having the width of the printing band having the reference line distance beginning from the position dot β1 of a first malfunctioning nozzle among nozzles detected in the detecting step S20 for every line.

For example, assuming that there are two malfunctioning nozzles and the malfunctioning nozzles are dot β1th nozzle and dot β2th nozzle respectively, the third printing operation S50 prints the first line (band 1) having width from dot 1 to dot N, and prints by inserting the inserting band (Irband 1) having width from dot 1 to dot N, which begins to print from the first position (dot β1) of the malfunctioning nozzles detected in the detecting step S20. Accordingly, as the dots (dot β1, dot β2) of the two malfunctioning nozzles occurred in the first line, they are reprinted by the inserting band (Irband 1) so that the finished product shows no malfunctioning nozzles. The above description assumes that the normal nozzle is positioned in the first malfunctioning nozzle. However, when the normal nozzle is positioned in a position of malfunctioning nozzles irrespective of any malfunctioning nozzle, the operation according to the present invention can be expected to be performed.

As the inserting band is inserted and paper is printed by means of the above-described method also in case of the presence of a number of malfunctioning nozzles in the jetting part of the ink head, white dots do not occur on printing paper. Accordingly the printing quality can be improved.

As the present invention prints using only the nozzles with exception of malfunctioning nozzles, white lines being occurred by the malfunctioning nozzles do not occur. Therefore, the printing quality can be improved.

It will be apparent to those skilled in the art that various modifications can be made in the method for improving printing quality of the present invention, without departing from the spirit of the invention. Thus, it is intended that the present invention cover such modifications as well as variations thereof, within the scope of the appended claims and their equivalents.

What is claimed is:

1. A printing quality improving method for rotating a line feed motor and printing as much as a width of a printing band, which has a reference line distance set by a line feed value, by being provided with a jetting part having a number of nozzles and jetting ink through the nozzles of said jetting part, said method comprising the steps of:

inputting a printing order;

detecting the quantity of malfunctioning nozzles among the nozzles of said jetting part in said inputting step and determining the location of said malfunctioning nozzles when malfunctioning nozzles are present;

printing firstly as much as a width of a printing band having a reference line distance set by a line feed value in case of the absence of a malfunctioning nozzle in said detecting step;

printing secondly a compensation letter line of one line for each of two lines by moving a functioning nozzle to two malfunctioning nozzle positions of each two neighboring lines, after printing with a first printing band, which has a smaller first line distance than said reference line distance, in case of the presence of a single malfunctioning nozzle in said detecting step; and printing thirdly as much as a width of the printing band having said line distance by positioning a functioning nozzle at a position of detected malfunctioning nozzles for every line having said reference line distance, printing as much as the width of the reference printing band having said reference line distance for every line in case of the presence of two or more malfunctioning nozzles in said detecting step.

2. The method as claimed in claim 1, wherein said detecting step comprises the steps of:

printing a test printing pattern for detecting the quantity of malfunctioning nozzles;

reading the printing pattern printed in said test printing step with a scanner;

comparing the data read in said reading step with the printing data in said test printing step; and detecting the number and position of malfunctioning nozzles in the case malfunctioning nozzles are present, comparing whether said read data agrees with said printed data in said comparing step.

3. The method as claimed in clam 2, wherein said test printing step gets ink jetted through said all nozzles, activating electrical signals, determining inkjetting, to each of said number of nozzles.

4. The method as claimed in clam 1, wherein said first printing band subtracts 2 from said number of nozzles.

5. A method of compensating for malfunctioning nozzles in a print head, comprising the steps of:

providing a print head that has two extra nozzles on one end of said print head that are unused during a normal printing operation when no malfunctioning nozzles are detected;

inputting a print order;

detecting the number and location of malfunctioning nozzles in said print head;

upon detection of a single malfunctioning nozzle, reprinting the deficiency left behind of a pair of printed lines at once by positioning the top nozzle of said print head at the location of the malfunctioning nozzle on said first line and allowing one of said two extra nozzles to print at the location of the deficiency left on said second line by said malfunctioning nozzle; and upon detection of two or more malfunctioning nozzles, reprinting a single line by positioning the first nozzle at the location of the first deficiency left behind by said first malfunctioning nozzle.

6. The method as claimed in claim 5, wherein said detecting step comprises the steps of:

printing a test printing pattern for detecting the quantity of malfunctioning nozzles;

reading the printing pattern printed in said test printing step with a scanner;

comparing the data read in said reading step with the printing data in said test printing step; and detecting the number and position of malfunctioning nozzles in the case malfunctioning nozzles are present, comparing whether said read data agrees with said printed data in said comparing step.

7. The method as claimed in claim 6, wherein said test printing step gets ink jetted through said all nozzles, activating electrical signals, determining inkjetting, to each of said number of nozzles.

8. A method for correcting the deficiencies of a printing head having malfunctioning nozzles, comprising the steps of:

providing an ink head that contains at least one extra nozzle on one end of said print head for compensation printing;

detecting the number and location of each malfunctioning nozzle on said print head;

printing a line of text on a sheet of paper, leaving behind deficient portions where malfunctioning nozzles are located;

in the case when two or more malfunctioning nozzles are present, reprinting the deficient portions of said printed line by repositioning a first nozzle on said print head at the location of a first malfunctioning print head; and in the case that only a single malfunctioning nozzle is present, printing a second line of text beneath said first line of text, repositioning said print head so that the first nozzle is at the location of the deficiency of said first print line and one of said extra nozzles is located at the deficiency of said second print line, and reprinting the deficiencies of both said first print line and said second print line simultaneously.

9. The method as claimed in claim 8, wherein said detecting step comprises the steps of:

printing a test printing pattern for detecting the quantity of malfunctioning nozzles;

reading the printing pattern printed in said test printing step with a scanner;

comparing the data read in said reading step with the printing data in said test printing step; and detecting the number and position of malfunctioning nozzles in the case malfunctioning nozzles are present, comparing whether said read data agrees with said printed data in said comparing step.

10. The method as claimed in claim 9, wherein said test printing step gets ink jetted through said all nozzles, activating electrical signals, determining inkjetting, to each of said number of nozzles.

11. The method as claimed in claim 8, wherein two extra nozzles are included on said print head.

* * * * *